United States Patent [19]

Pundyk

[11] Patent Number: 4,538,615

[45] Date of Patent: Sep. 3, 1985

[54] MULTIPANEL FOUNDATION GARMENT

[75] Inventor: Bernard Pundyk, So. Orange, N.J.

[73] Assignee: Glamorise Foundations Inc., New York, N.Y.

[21] Appl. No.: 572,369

[22] Filed: Jan. 20, 1984

[51] Int. Cl.[3] ..... A41C 1/00

[52] U.S. Cl. ..... 128/555

[58] Field of Search ..... 128/555, 554, 539, 546, 128/542, 548

[56] References Cited

U.S. PATENT DOCUMENTS

| | | | |
|---|---|---|---|
| 2,199,442 | 5/1940 | Mayonnade et al. . | |
| 2,327,310 | 8/1943 | Lewis . | |
| 2,608,688 | 9/1952 | Leonard . | |
| 2,651,778 | 9/1953 | Wohlman | 128/554 |
| 2,745,103 | 5/1956 | Van Horne . | |
| 2,977,959 | 4/1961 | Welsch | 128/554 |
| 3,142,302 | 7/1964 | Schonberg . | |
| 3,221,750 | 12/1965 | Blair . | |
| 3,507,286 | 4/1970 | Salisky . | |

FOREIGN PATENT DOCUMENTS 2002970 2/1969 France .

*Primary Examiner*—Doris L. Troutman

*Attorney, Agent, or Firm*—Larson and Taylor

[57] ABSTRACT

A multipanel foundation garment is disclosed in which each of the panels has a unidirectional line of stretch and has a shape selected such that the lines of stretch are in the direction of movement of the contacting body part. Such a foundation garment performs its normal function of confining stationary fatty parts of the body and further confines those parts during movement of the body. In a particular embodiment, a panty girdle is comprised of six panels. A front panel has the direction of stretch in the longitudinal direction with respect to the wearer and is surrounded by two elongate, side panels together forming an ogee frame and which have lines of stretch in the mutually opposing bias directions. Two back panels, connected to each other along their respective edges and connected along the other edges to the edges of the side panels have their respective lines of stretch in the transverse direction. The sixth panel is a crotch panel and is attached at each of its ends to the lower ends of the side panels and to the lower ends of the back panel. The lines of stretch of the crotch panel is also in the same plane as the line of stretch of the front panel. Bunching of the girdle is limited by extending the side panels below the front panel such that there is no direct connection between the front panel and the crotch panel.

14 Claims, 8 Drawing Figures

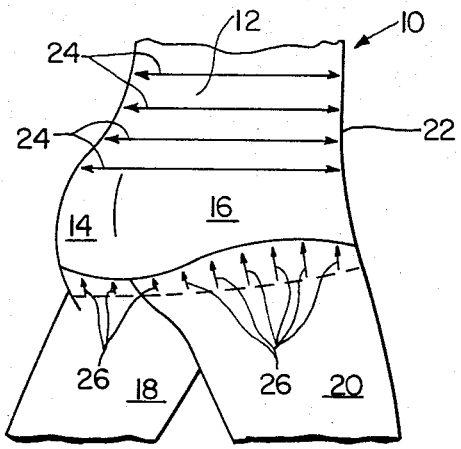
FIG. 1
PRIOR ART
FIG. 2
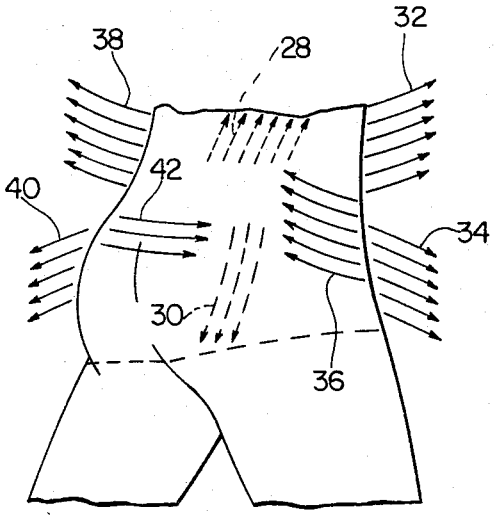
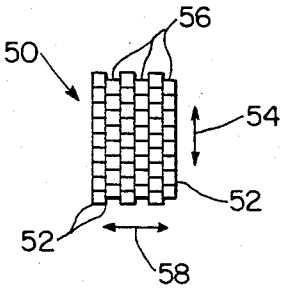
FIG. 3
PRIOR ART
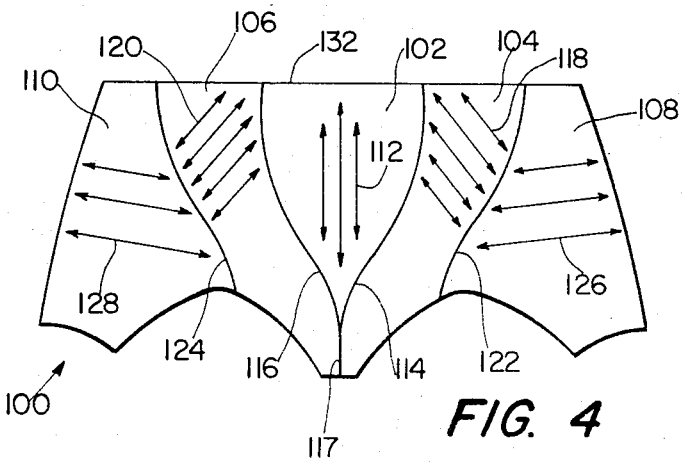
FIG. 4
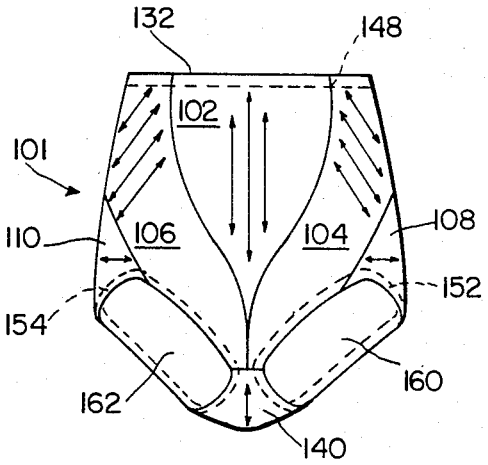
FIG. 5
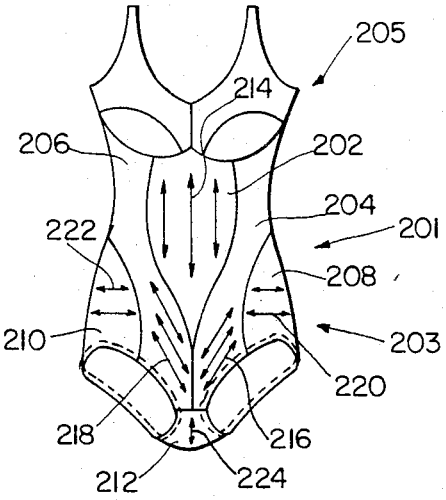
FIG. 8

MULTIPANEL FOUNDATION GARMENT

FIELD OF THE INVENTION

The present invention relates to improvements in foundation garments such as girdles, panty girdles, corselettes, all-in-ones, swimming suits, and the like.

BACKGROUND OF THE INVENTION

Most contemporary foundation garments employ an elastic material having a unidirectional "true" elongation. This true stretch results from the elastomer in the material being laid in only a single line so that the stretch of the garment occurs along this line or direction. Contemporary foundation garment manufacturers have generally attempted to determine the most critical need with respect to the direction of stretch and construct the foundation garments based on that evaluation.

However, any single direction of stretch must be a compromise to the true requirements of the wearer. These requirements include a garment that fits the stationary figure and gives a thin appearance in the abdominal and buttock areas. Such conventional garments act only to compress or squeeze the body without accounting for the motion of the body and the particular deposition of fatty tissues.

Some prior art foundation garments have attempted to overcome the various requirements for stretch. Such foundation garments are disclosed in the following patents: French Pat. No. 2,002,970 and U.S. Pat. Nos. 2,199,442 to Mayonnade et al; 2,327,310 to Lewis; 3,221,750 to Blair; 2,608,688 to Leonard; 3,507,286 to Salisky; 3,142,302 to Schonberg and 2,745,103 to Van Horne. Each of these patents discloses a foundation garment that is comprised of a number of panels that are joined together. The Mayonnade patent connects some elastic panels with others that are more rigid. The Lewis patent teaches the use of the superimposition of rigid material directly on the elastic material so as to limit stretch in various directions on the garment. The Leonard patent discloses a plurality of tapered panels having a single line of stretch in each panel. The Salisky patent discloses overlapping various panels to increase the thickness at different points at a location where the least stretch is needed. The Blair patent also discloses a number of "control" and "release" areas so as to control the stretch at various body locations. The Schonberg patent discloses a main body fabric having a two-way stretch material with several V-shaped bands of longitudinal stretch material. The Van Horne patent discloses a girdle that has folds of the material sewn together to give added effect in certain areas. The French patent discloses an undergarment comprised of a plurality of panels connected to each other where the stretch of each panel is unidirectional and the direction of stretch is supposedly oriented in the same direction as the underlying muscular structure. However, none of these patents discloses the need for having a foundation garment made of a plurality of panels having unidirectional lines of stretch that extend in the direction of movement of the underlying body parts.

SUMMARY OF THE INVENTION

Accordingly, it is an object of the present invention to provide a foundation garment permitting the highest possible degree of movement of the wearer and having an invisible figure controlling power such that the garment neither slips nor pulls upwardly or downwardly, and does not cut into or constrict the skin of the wearer. By supporting and constricting the underlying body part in its primary direction of movement, the foundation garment not only performs its fundamental function of producing a slimming appearance by holding in protruding fatty body portions of a stationary body, but also maintains a slimming appearance with greater comfort during normal movement of the body. The present invention accomplishes these objectives by providing a foundation garment that is comprised of a plurality of panels each having a unidirectional true line of stretch wherein the direction of stretch relates to the needs of movement of the wearer. Such a foundation garment has component panels that have unidirectional true lines of stretch in the direction of movement of the contacting body part so that the garment can flow with the body movement and yet still permit the garment to perform its basic function.

For example, when the wearer of a foundation garment sits down, the bulk of the buttocks moves in an outward direction as a result of compression causes by movement of the body skeleton. A concave bending of the body relaxes the muscles in the stomach area (the straight abdominal muscular system including the rectus abdominis musculus) resulting in a downward movement of the abdominal fatty tissue.

A multipanel foundation garment according to the present invention in which the lines of stretch of each panel extend in the direction of body movement permits a greater freedom of body movement, fit better, cling to the body. Such a garment adapts to the body's every movement, whether sitting, standing, stooping, walking, twisting, or other type of motion. The foundation garment can be worn without any inconvenience and has a construction, fit and freedom of movement that is in harmony with the movement of the body.

However, it has been found that the separate movements of the individual body parts are not necessarily in the same direction in which the muscles run. This is particularly true where there are skeletonal joints or where muscles cross over one another and act in different directions. The function of a foundation garment, after all, is to hold in and support the body at the points of greatest need, and in many cases the direction of this support is opposite to the direction of muscle movement.

A foundation garment according to the present invention comprises a plurality of elastic fabric panels joined together along their adjacent edges to form an integral garment. Each panel has a true elastic stretch only along one line and the line of stretch of each panel being in the direction to supportingly confine the abutting body portion of a wearer along the direction of movement of that body portion.

In a particular embodiment of the present invention, the foundation garment comprises a first elongate panel having a longitudinal line of stretch with respect to a wearer and located at the central front portion of the garment. Second and third elongate panels are connected only along their respective adjacent edges to the first panel and have a bias line of stretch with respect to the first panel. Connected to the second and third elongate panels is a rear section having a transverse line of stretch with respect to the first panel.

These and other objects, features and improvements of the present invention are set forth in or are inherent from the detailed description of the presently preferred embodiments hereinbelow.

BRIEF DESCRIPTION OF THE DRAWINGS

FIG. 1 is a schematic representation of a prior art foundation garment on a human figure in which the lines of stretch of the garment are depicted.

FIG. 2 is a diagrammatic sketch of a rear view of part of the human figure depicting the lines of movement of the various parts of the body.

FIG. 3 is an enlarged view of part of the fibers of a conventional foundation garment material in which the material has a unidirectional line of stretch.

FIG. 4 is a plan view of part of a foundation garment according to the present invention shown spread-out.

FIG. 5 is a front elevational view of a foundation girdle according to the present invention.

FIG. 8 is a front elevational view of an "all-in-one" foundation garment.

DESCRIPTION OF THE PREFERRED EMBODIMENTS

Figure 6:
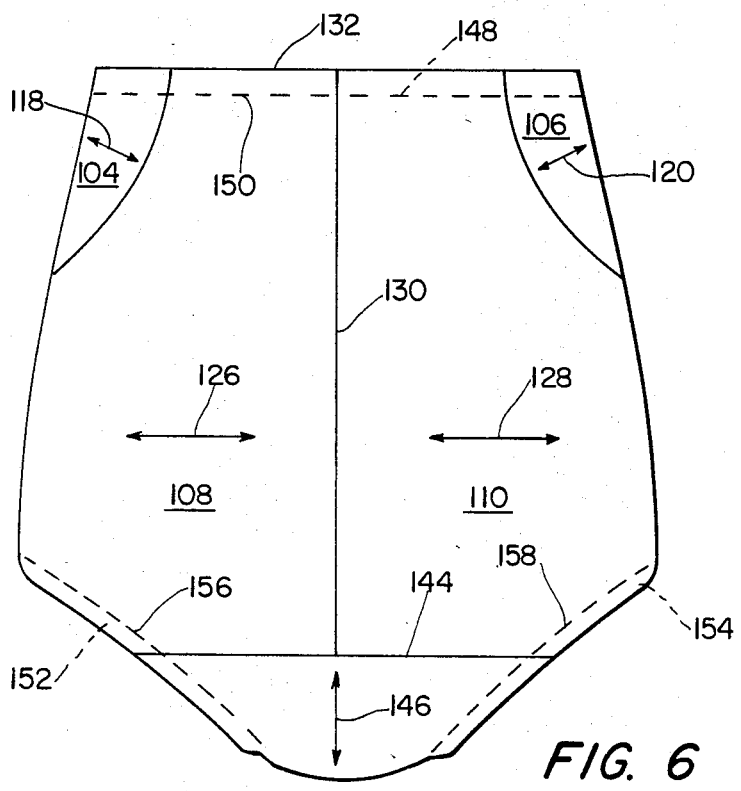
FIG. 6 is a back elevational view of the garment depicted in FIG. 5.

FIG. 1 discloses a human body 10 viewed from the right hind quarter and depicting a lower back area 12, a left buttock 14, a right buttock 16 and left and right legs 18 and 20. A conventional foundation garment 22 is being worn by body 10 and is comprised of a material having a unidirectional line of stretch indicated in the direction of arrows 24. Unfortunately, foundation garment 22 has the disadvantage of not having lines of stretch which extend in the movement of various parts of the body. Thus, as the body moves, there will be a transversal stretch pulling upwardly and downwardly as depicted by arrows 26.

With reference to FIG. 2, body 10 is depicted with superimposed groups of arrows showing the true requirements for stretch in a foundation garment. Arrow groups 28 and 30, shown in dashed lines, depict the vertical movement of body tissue on the front abdominal area of the body. Arrow groups 32, 34 and 36 show the bias movement of body tissue on the right side of body 10 while arrow groups 38 and 40 show the corresponding bias movement on the left side of body 10. Finally, arrow group 42 shows the horizontal movement of body tissue across the buttocks area of body 10.

With reference now to FIG. 3, a section of an elastic material 50 is depicted having a plurality of parallel elastomers 52, all of which run in the same direction (which is vertical in FIG. 3). Therefore, the direction of true stretch of material 50 would be in the vertical direction as depicted by arrow 54. Elastomers 52 correspond to the warp of knitted materials. Connecting each of the elastomers are a plurality of weft stringers 56. Weft stringers 56 are nonelastic, but because of the spacing utilized, there is some give between elastomers 52 running in the direction of weft stringers 56, as depicted by arrow 58. This direction of movement is a false stretch whereas the stretch in the elastomeric direction as indicated by arrow 54 is a "true stretch."

The present invention will now be described with respect to FIGS. 4 through 8. In FIG. 4, there is depicted a girdle piece 100 having five panels connected together only along their mutally abutting edges. These panels include a front panel 102, left and right side panels 104 and 106, (as seen from the perspective of the wearer), and left and right rear panels 108 and 110 (also as seen from the perspective of the wearer). Obviously, when a garment is formed from girdle piece 100, rear panels 108 and 110 are connected together along the outer edges thereof, as seen in FIG. 4.

As described in greater detail hereinbelow, each of the panels 102, 104, 106, 108 and 110 has a unidirectional or single line of stretch. Front panel 102 has the shape of an inverted ogee arch and the direction of stretch is in the longitudinal or vertical direction with respect to the wearer and as depicted by arrows 112. Panels 104 and 106 together form an ogee frame surrounding front panel 102 and attached thereto only along the respective, abutting edges to form seams 114 and 116, respectively. Similarly, panels 104 and 106 are connected to each other below the bottom tip of panel 102 only along their respective, abutting edges to form seam 117. Preferably, seams 114, 116, and 117 are made by conventional sewing techniques utilizing conventional cotton thread. One such technique comprises overlying the abutting two edges by a small amount and stitching them together using weft and warp heavy stitching. Obviously, the overlap created (not shown) is turned to the inside of the garment so as not to be seen from the outside.

Panels 104 and 106 together comprise the framing of an ogee arch and completely surround the sides and bottom of front panel 102. The direction of stretch in panel 104 and 106 is in the inward bias direction as depicted by arrrows 118 and 120, respectively. Alternatively, the direction of stretch of side panels 104 and 106 could be in the downward bias direction (so as to form a "V" instead of a reverse "V" as depicted in FIG. 4).

Rear panels 108 and 110 are connected only along their inward edges (as depicted in FIG. 4) to side panels 104 and 106, respectively. These connections can be made, for example, by conventional sewing techniques so as to form seams 122 and 124. The direction of stretch in rear panels 108 and 110 is in the horizontal direction with respect to the wearer and as depicted by arrows 126 and 128, respectively.

As mentioned above, girdle piece 100 is depicted in the laid-out condition. A girdle would be made from girdle piece 100 by connecting the outside edges (as depicted in FIG. 4) of rear pieces 108 and 110 to form a seam 130 (depicted in FIG. 6). The tops of pieces 102, 104, 106, 108 and 110 are cut so as to form an arcuate top edge 132.

The bottom edge of girdle piece 100 is a plurality of interconnected arcuate lines which, as described below, form the edges for leg holes and connect to a sixth panel 140, depicted in FIG. 7 and described hereinbelow.

Figure 7:
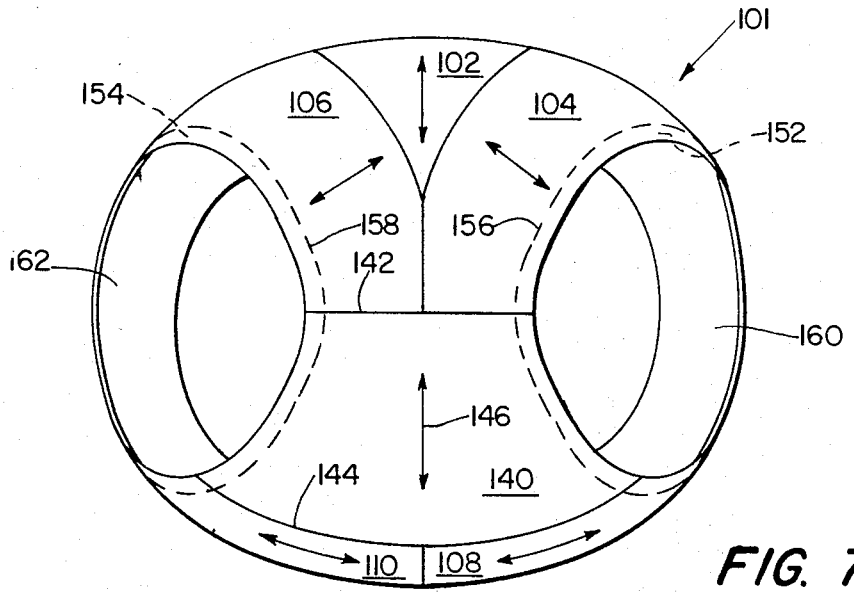
FIG. 7 is a bottom plan view of the garment depicted in FIG. 5.

With reference now to FIGS. 5, 6 and 7, there is depicted a panty girdle 101 which is made from girdle piece 100 (FIG. 4) by joining left rear panel 108 to right rear panel 110, thereby forming seam 130, and adding a sixth panel or crotch panel 140. Crotch panel 140 is connected, such as by sewing, only along the edges thereof to the corresponding edges along the bottom of side panels 104 and 106 to form a seam 142 at one end of panel 140 and only along the edges thereof to the corresponding edges along rear panels 108 and 110 to form a seam 144 at the other end of panel 140. The direction of stretch of crotch panel 140 is depicted by arrow 146 and is in a direction so as to pull seams 142 and 144 together. Thus, as seen in FIG. 7, the unidirectional, true stretch of crotch panel 140 is in the same direction as the true stretch of front panel 102.

Girdle 101 also includes an elastic waist band 148 that is connnected along the bottom thereof to the inside top edge section 132 of girdle 101. Waist band 148 can be connected, for example, by sewing and thereby form a seam 150. Two elastic leg bands 152 and 154 are respectively connected to the inside of the lower edges of panels 108 and 104 and to the bottom edges of panels 106 and 110. In addition, leg bands 152 and 154 are connected to either side of crotch panel 140. The connections can be made by sewing which thereby forms seams 156 and 158 for leg bands 152 and 154 respectively, which in turn define girdle leg holes 160 and 162, respectively.

With reference now to FIG. 8, there is depicted an "all-in-one" foundation garment 201 comprised of a lower panty girdle section 203 and an upper brassiere section 205. Girdle section 203 is constructed using a plurality of unidirectional stretch panels or pieces connected together to form an integral garment in which the panels are shaped similar to those of panty girdle 101 depicted in FIG. 5. In addition, brassiere section 205 is integral with the top of girdle section 203. Obviously, girdle section 203 is longer than girdle 101 and does not include a waist band 148.

The panels that comprise girdle section 203 include a front panel 202, a left side panel 204 and a right side panel 206 integrally connected along the edges thereof to the edges of front panel 202, a left rear panel 208 and a right rear panel 210 connected together in the back of the garment (not shown) and to side panels 204 and 206, respectively, and a crotch panel 212. As depicted in FIG. 8, front panel has a unidirectional true line of stretch in the longitudinal or vertical direction as depicted by arrows 214 and left and right side panels have a unidirectional true line of stretch in the bias direction as indicated by arrows 216 and 218, respectively. However, the bias stretch lines of left and right side panels 204 and 206 define a regular "V" and thus are in the opposite direction of the inverted "V" formed by the lines of stretch of panels 104 and 106 depicted in panty girdle 101 of FIG. 5. Rear panels 108 and 110 have unidirectional true lines of stretch in the transverse or horizontal direction as indicated by arrows 220 and 222, respectively. Finally, crotch panel 212 has a unidirectional true line of stretch in the front circular plane that is parallel to the lines of stretch indicated by arrows 214 of front panel 202 and perpendicular to the lines of stretch in the rear section indicated by arrows 220 and 222 of rear panels 208 and 210, respectively. The unidirectional true lines of stretch for crotch panel 212 is indicated by arrow 224.

Accordingly, the present invention has been described with respect to a plurality of embodiments of multipanel foundation garments. Each of the panels has a unidirectional line of elasticity and the sizes, shapes, location and direction of stretch for each panel are determined in accordance with the movement of the underlying, contacting body portion. Thus the garment is able to confine the fatty portions of the body for a wearer who is both stationary and moving. In addition, some of the panels have additional functions to prevent other panels from shifting when the body of the wearer is moved in certain directions. For example, crotch panel 140 has a tendency to keep the panels comprising the front of the girdle and the panels comprising the back of the girdle from upward movements with respect to each other. In addition, by locating panels 106 and 104 below panel 102, there is a minimal bunching up of the material in the crotch area when the wearer sits down. Similarly, the transverse directions of stretch of panels 108 and 110 of panty girdle 101 prevent a bunching up of the material that comprises panels 106, 102 and 104 when the wearer sits down.

While the present invention has been described with respect to particular embodiments thereof, other modifications would be obvious to those skilled in the art.

I claim:

1. A foundation garment having an upper opening and at least one lower opening as defined with respect to a wearer, the garment comprising a plurality of elastic fabric panels joined together along their respective adjacent edges to form an integral garment, each panel having a true elastic stretch only along one line, said panels including a first elongate front panel having a longitudinal line of stretch with respect to a wearer and located at the central front portion of the garment;

second and third elongate side panels having a bias line of stretch with respect to said front panel and being joined along each side of said front panel; and a rear section having lateral lines of stretch and forming the rear portion of the garment, the edges of said rear section being joined to the edges of said second and third panels.

2. A foundation garment as claimed in claim 1 wherein the lines of true stretch of said side panels are in opposing diagonals with respect to said central panel.

3. A foundation garment as claimed in claim 1 wherein said rear garment section overlies the buttocks of a wearer and has unidirectional line of true stretch in the transverse direction with respect to said central panel so as to control horizontal movement of the buttocks.

4. A foundation garment as claimed in claim 3 wherein said rear section is comprised of two rear panels of substantially similar dimensions, said rear panels being connected together only along their respective abutting edges, each rear panel for overlying a corresponding buttock of the wearer.

5. A foundation garment as claimed in claim 3 wherein the lower ends of said side panels extend below the lower end of said central panel and are connected to each other only along their mutually abutting edges.

6. A foundation garment as claimed in claim 5 and further comprising a crotch panel connected along one of its edges only to the lower edge of said rear section and is connected along a second edge that is opposite said one edge only to the lower edges of said side panels lower edges; and wherein said garment has two openings in the bottom for receiving the legs of the wearer.

7. A foundation garment as claimed in claim 6 wherein said crotch panel has a unidirectional line of true stretch corresponding to the line of true stretch of said central panel.

8. A foundation garment as claimed in claim 1 wherein the lower end of each of said side panels extends below the lower end of said front panel and are connected to each other along their mutually abutting edges.

9. A foundation garment as claimed in claim 8 wherein said front panel is in the shape of an inverted ogee and said side panels together form an inverted ogee arch.

10. A foundation garment as claimed in claim 1 and further including a crotch panel having opposing first and second edges and being connected along said first edge thereof to the lower end edges of said side panels, and connected along said second edge thereof to the lower end edge of said rear section.

11. A foundation garment as claimed in claim 10 wherein said crotch panel has a unidirectional line of true stretch corresponding to the line of true stretch of said front panel.

12. A foundation garment as claimed in claim 1 wherein said rear section is comprised of two rear panels of substantially similar dimensions, said rear panels being connected together along their respective abutting edges.

13. A foundation garment as claimed in claim 8 wherein said foundation garment is a panty girdle having a large top opening, defined by an elastic stretch band, and wherein the top edges of said front panel, said side panels and said rear section are connected to said stretch band.

14. A foundation garment as claimed in claim 8 wherein said foundation garment is an all-in-one garment and further includes a bra section; and wherein the top edges of said front panel, said side panels and said rear section are connected to the lower edge of said bra section.

* * * * *